US006760982B2

(12) United States Patent
Chen et al.

(10) Patent No.: US 6,760,982 B2
(45) Date of Patent: Jul. 13, 2004

(54) WATERPROOF SHOE HAVING AN ELASTIC TOP OPEN END

(75) Inventors: Eddie Chen, 9F, No. 201, Sec. 1, Taichung-Kang Rd., Taichung (TW); Melissa Wang, Taichung (TW)

(73) Assignee: Eddie Chen, Taichung (TW)

( * ) Notice: Subject to any disclaimer, the term of this patent is extended or adjusted under 35 U.S.C. 154(b) by 86 days.

(21) Appl. No.: 10/267,429

(22) Filed: Oct. 8, 2002

(65) Prior Publication Data

US 2004/0064972 A1 Apr. 8, 2004

(51) Int. Cl.[7] ..... A43B 23/07; A43B 23/26
(52) U.S. Cl. ..... 36/55; 36/45; 36/51; 36/54
(58) Field of Search ..... 36/10, 55, 45, 36/54, 51

(56) References Cited

U.S. PATENT DOCUMENTS

| | | | | | |
|---|---|---|---|---|---|
| 2,039,287 | A | | 5/1936 | Arnold | 12/142 |
| 2,201,383 | A | | 5/1940 | Vizard | 36/17 |
| D341,481 | S | | 11/1993 | Peterson | D2/320 |
| RE34,890 | E | * | 4/1995 | Sacre | 36/55 |
| D383,893 | S | | 9/1997 | Leick | D2/897 |
| D385,987 | S | | 11/1997 | Bramani | D2/959 |
| 5,802,740 | A | * | 9/1998 | Merk, Sr. | 36/55 |
| D402,095 | S | | 12/1998 | Cretinon | D2/957 |
| D414,023 | S | | 9/1999 | Cretinon et al. | D2/957 |
| D414,594 | S | | 10/1999 | Parisotto | D2/959 |
| 5,964,047 | A | * | 10/1999 | Covatch | 36/55 |
| D416,669 | S | | 11/1999 | Parr et al. | D2/954 |
| D420,497 | S | | 2/2000 | Panella | D2/957 |
| 6,065,227 | A | * | 5/2000 | Chen | 36/4 |
| D433,791 | S | | 11/2000 | Laberge | D2/957 |
| D434,550 | S | | 12/2000 | LaBerge | D2/957 |
| D439,031 | S | | 3/2001 | Matis et al. | D2/959 |
| D440,749 | S | | 4/2001 | Rogers | D2/959 |
| D442,768 | S | | 5/2001 | Matis | D2/957 |
| 6,305,101 | B2 | * | 10/2001 | Chemello | 36/10 |
| D450,428 | S | | 11/2001 | Cretinon et al. | D2/953 |
| 6,367,166 | B1 | * | 4/2002 | Barthelemy et al. | 36/3 R |
| D456,982 | S | | 5/2002 | Rogers | D2/957 |
| D460,608 | S | | 7/2002 | Laberge et al. | D2/957 |
| 6,412,193 | B1 | | 7/2002 | Chen | 36/14 |
| D462,157 | S | | 9/2002 | Burt | D2/953 |
| D467,712 | S | | 12/2002 | Delgorgue et al. | D2/957 |
| D468,083 | S | | 1/2003 | Morais | D2/960 |
| 2003/0093919 | A1 | * | 5/2003 | Wang | 36/10 |
| 2003/0200679 | A1 | * | 10/2003 | Wilson et al. | 36/55 |

OTHER PUBLICATIONS

U.S. patent application Ser. No. 10/241,919, Chen, filed Sep. 12, 2002.

U.S. patent application Ser. No. 29/167,920, Chen et al., filed Sep. 23, 2002.

U.S. patent application Ser. No. 10/285,248, Chen et al., filed Oct. 30, 2002.

U.S. patent application Ser. No. 10/303,136, Chen et al., filed Nov. 21, 2002.

* cited by examiner

*Primary Examiner*—M. D. Patterson
(74) *Attorney, Agent, or Firm*—Ladas & Parry

(57) ABSTRACT

A shoe includes an upper with a first notched edge, an inner lining disposed inside the upper and having a second notched edge in alignment with the first notched edge, and a sock-like waterproof lining made of a waterproof breathable membrane and disposed between the upper and the inner lining. The waterproof lining has a third notched edge in alignment with the first notched edge. An elastic part spans the first, second and third notched edges, and has an outer layer and an inner layer both of which are elastic. The inner layer has a peripheral edge attached to the second notched edge to form an inner seam. The outer layer has a peripheral edge attached to the first notched edge to form an outer seam. The third notched edge is attached to one of the first and second notched edges along one of the inner and outer seams.

12 Claims, 15 Drawing Sheets

WATERPROOF SHOE HAVING AN ELASTIC TOP OPEN END

BACKGROUND OF THE INVENTION

1. Field of the Invention

The invention relates to a shoe, more particularly to a waterproof shoe which has an elastic and stretchable top open end.

2. Description of the Related Art

FIG. 1 shows a conventional sock-like lining 1 used to line an upper of a shoe. The sock-like lining 1 has a tongue portion 101 which is pleated at two side parts 1011. The lining 1 includes a waterproof breathable membrane layer so that, when it is used in a waterproof shoe, it permits ventilation, in addition to providing waterproofing characteristics.

However, the lining 1 entails the following drawbacks:

1. Since the stretchability of the waterproof breathable membrane is limited, the tongue portion 101 of the lining 1 must be pleated at two side parts 1011 to provide a larger opening for the entry of the wearer's foot. Since the pleated side parts 1011 require an increased quantity of the waterproof breathable material and since the waterproof breathable material is generally expensive as compared with the other sheet materials used for making shoes, the use of the lining 1 can increase the cost of the shoe material. On the other hand, the pleated tongue portion 101 can produce pressure on the instep of the wearer's foot and cause discomfort to the wearer's foot.
2. The lining 1 is in the form of a loop which defines an opening at the top end of the lining 1. Since the waterproof breathable membrane has limited stretchability, the breathable membrane can run the risk of breaking when the wearer overly stretches the lining 1, thus impairing the waterproofing characteristics of the lining 1.
3. In extremely cold weather areas, it is common to insert an interior shoe into a waterproof shoe to keep warmness within the shoe. The conventional waterproof shoe incorporating such a lining 1 is generally inconvenient for insertion or removal of the interior shoe due to the insufficient stretchability of the lining 1.

SUMMARY OF THE INVENTION

An object of this invention is to provide a shoe with a waterproof breathable lining which incorporates an elastic part, thereby eliminating the need to pleat the lining while still providing a stretchable opening to facilitate entry of the wearer's foot.

Accordingly, the present invention provides a shoe which comprises: an upper having a first top end and a first notched edge extending downward from the first top end; an inner lining disposed inside the upper, and having a second top end and a second notched edge extending downwards from the second top end and being substantially in alignment with the first notched edge; a substantially sock-like waterproof lining made of a waterproof breathable membrane and disposed between the upper and the inner lining, the waterproof lining having a third top end and a third notched edge extending downwards from the third top end and being in alignment with the first notched edge; an elastic part to span the first, second and third notched edges, and having an outer layer and an inner layer both of which are elastic and stretchable, the outer and inner layers including top ends connected to each other, the inner layer having a peripheral edge extending downward from the top end of the inner layer and attached to the second notched edge, thus forming an inner seam, the outer layer having a peripheral edge extending downward from the top end of the outer layer and attached to the first notched edge, thus forming an outer seam, the third notched edge of the waterproof lining being attached to one of the first and second notched edges along one of the inner and outer seams; and a watertight sealing member to seal at least one of the inner and outer seams.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
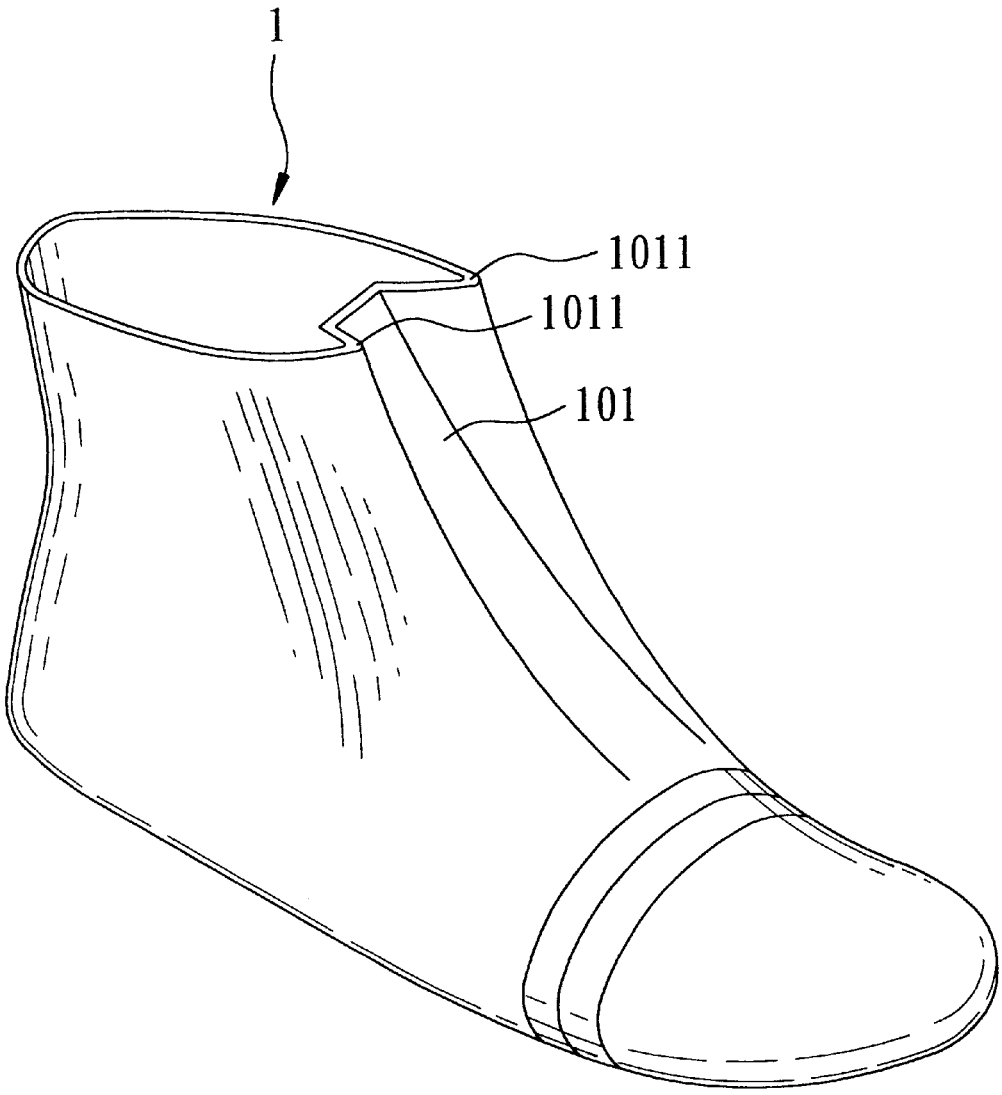
FIG. 1 PRIOR ART
FIG. 1 shows a conventional sock-like lining.
Figure 2:
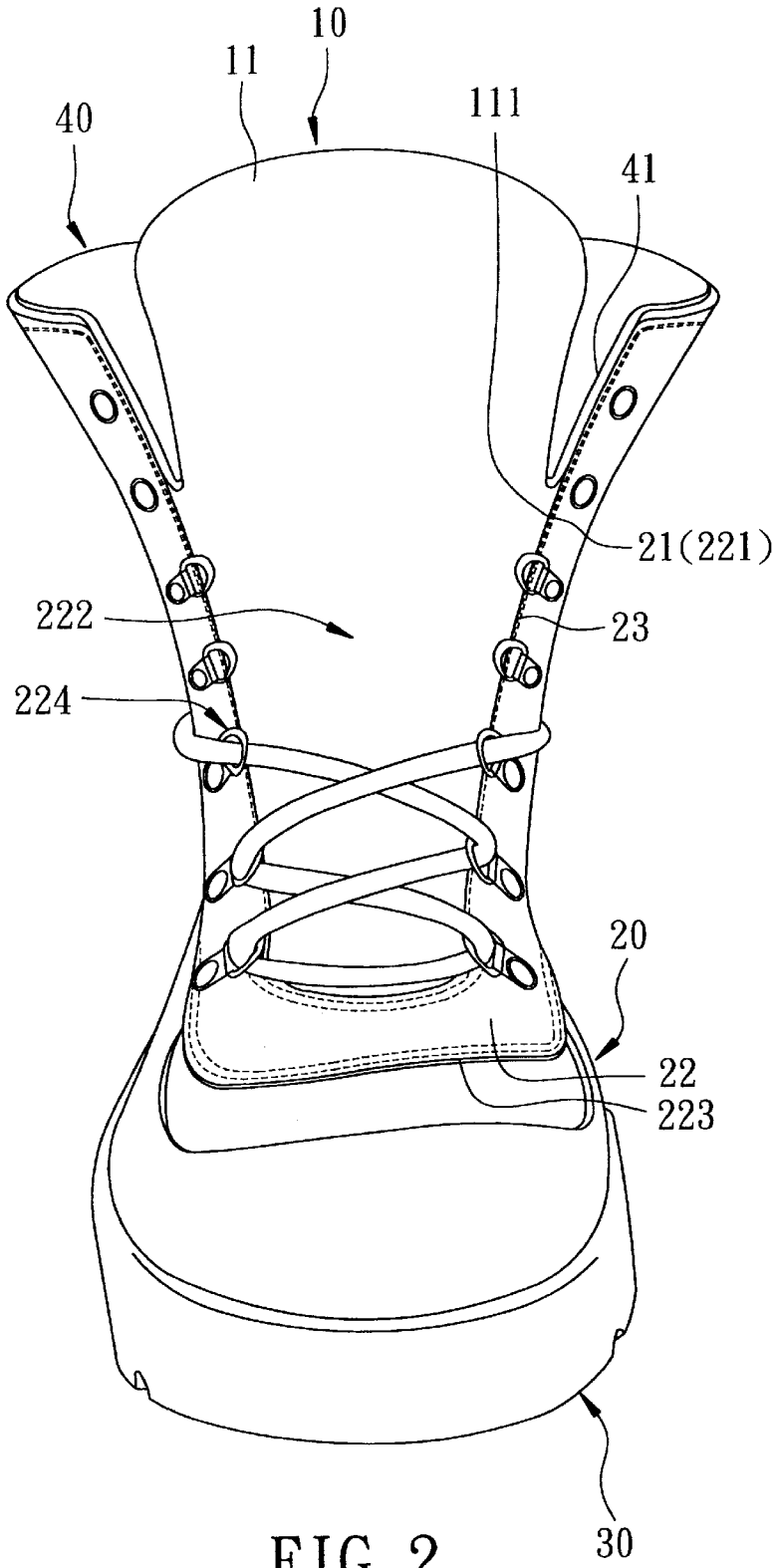
FIG. 2 is a front view of a shoe of the first embodiment of the present invention.
Figure 3:
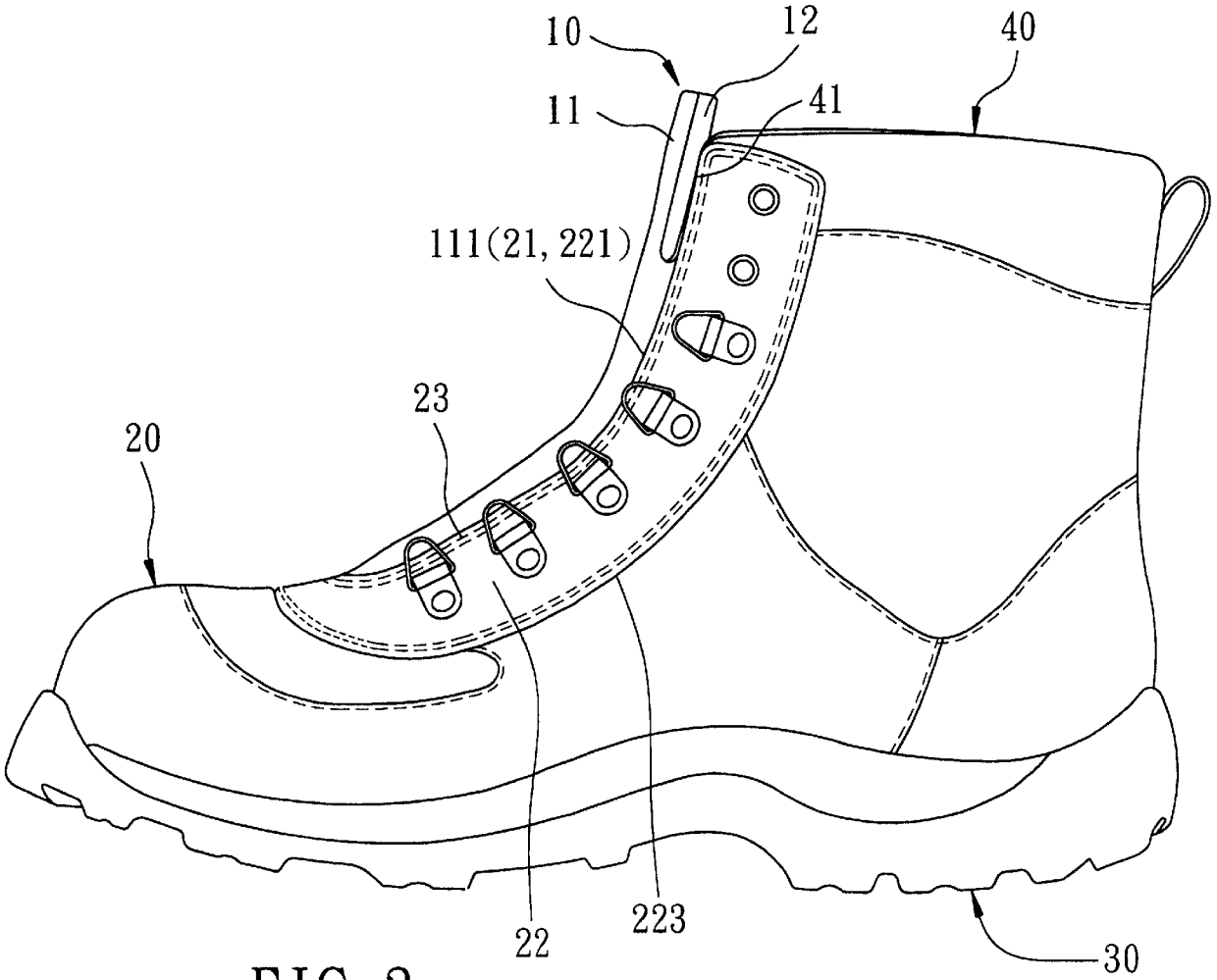
FIG. 3 is a side view of the shoe of FIG. 2.
Figure 4:
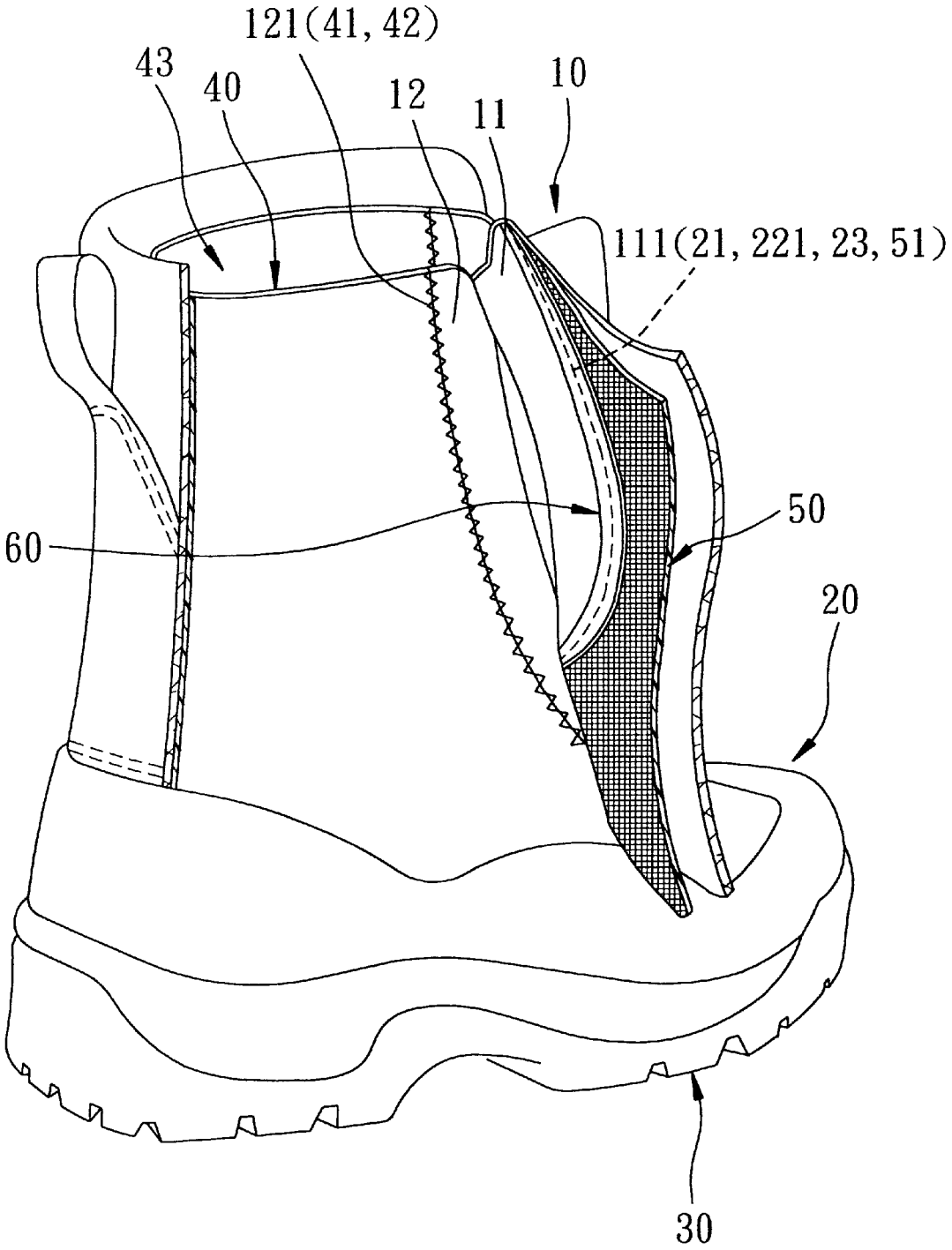
FIG. 4 is a partially sectioned view of the shoe of FIG. 2.
Figure 5:
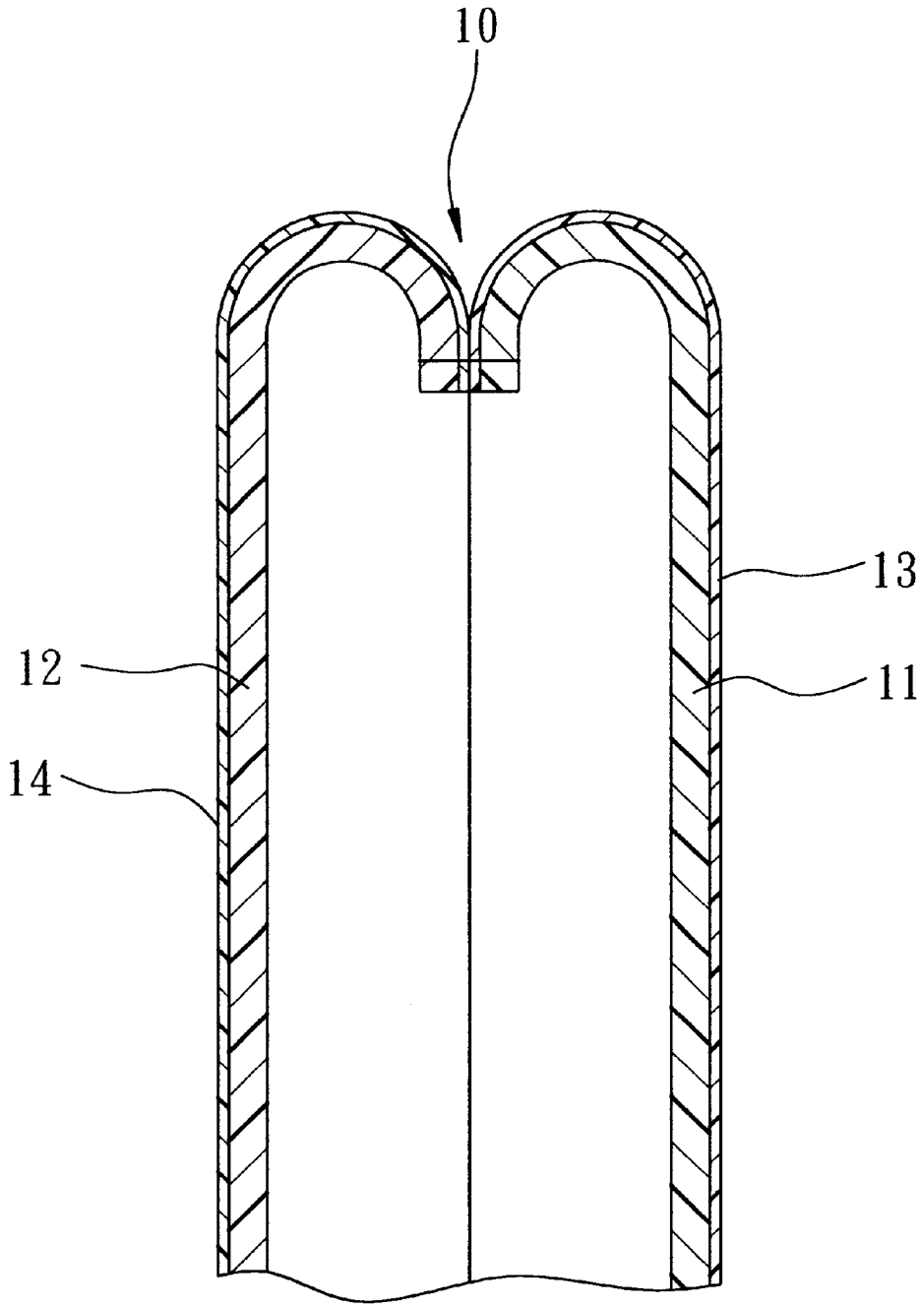
FIG. 5 is a fragmentary sectional view of the tongue used in the shoe of FIG. 2.

Referring to FIGS. 2–5, a first embodiment of the shoe according to the present invention is shown to have an elastic part or an elastic tongue 10, an upper 20, an outsole 30, an inner lining 40, a waterproof lining 50 and a watertight sealing member 60.

The tongue 10 is composed of an outer layer 11 and an inner layer 12 which are stitched together at top ends of the outer and inner layers 11, 12. The outer and inner layers 11, 12 are covered respectively by stretchable elastic fabric layers 13 and 14 as best shown FIG. 5 in order to improve appearance. The fabric layers 13 and 14 may be made of an elastic fabric material, such as the product sold under the trademark, "Lycra" or "Spandex". The outer and inner layers 11, 12 are elastic, and at least one of the outer and inner layers 11, 12 is waterproof. Specifically, in this embodiment, the outer layer 11 is made of an elastic waterproof material, such as neoprene, in order to prevent the entry of water, whereas the inner layer 12 is made of a non-waterproof stretchable elastic fabric material. Certainly, a stretchable waterproof material may also be used to make the inner layer 12. The tongue 10 has a peripheral edge which is constituted of the peripheral edge 111 of the outer layer 11 and the peripheral edge 121 of the inner layer 12.

The upper 20 includes a first notched edge 21 which extends downward from the top open end of the upper 20, and a substantially U-shaped eyelet plate 22. The first notched edge 21 is contoured to substantially correspond to the peripheral edge of the tongue 10 and confines a cutout 222 at an instep part of the upper 20. The eyelet plate 22 has a substantially U-shaped inner edge 221, a substantially U-shaped outer edge 223 spaced apart from and extending around the inner edge 221, and a plurality of eyelets disposed along the inner edge 221. In this embodiment, the inner edge 221 of the eyelet plate 22 defines the first notched edge 21 of the upper 20 and thus confines the cutout 222. The peripheral edge 111 of the outer layer 11 is attached, via a stitching process, to the first notched edge 21 of the upper or the inner edge 221 of the eyelet plate 22, thus forming an outer seam 23. The outsole 30 is attached to the bottom end of the upper 20.

The inner lining 40 is disposed inside the upper 20 and has a second notched edge 41 extending downward from a top open end of the inner lining 40 and contoured to correspond to the peripheral edge of the tongue 10. The peripheral edge 121 of the inner layer 12 of the tongue 10 is attached, via a stitching process, to the second notched edge 41, thus forming an inner seam 42. As such, the tongue 10 spans the first notched edge 21 of the upper 20 and the second notched edge 41 of the inner lining 40. The top end of the tongue 10 and the top open ends of the upper 20 and the inner lining 40 cooperate to define a top opening 43 of the upper 20.

Figure 6:
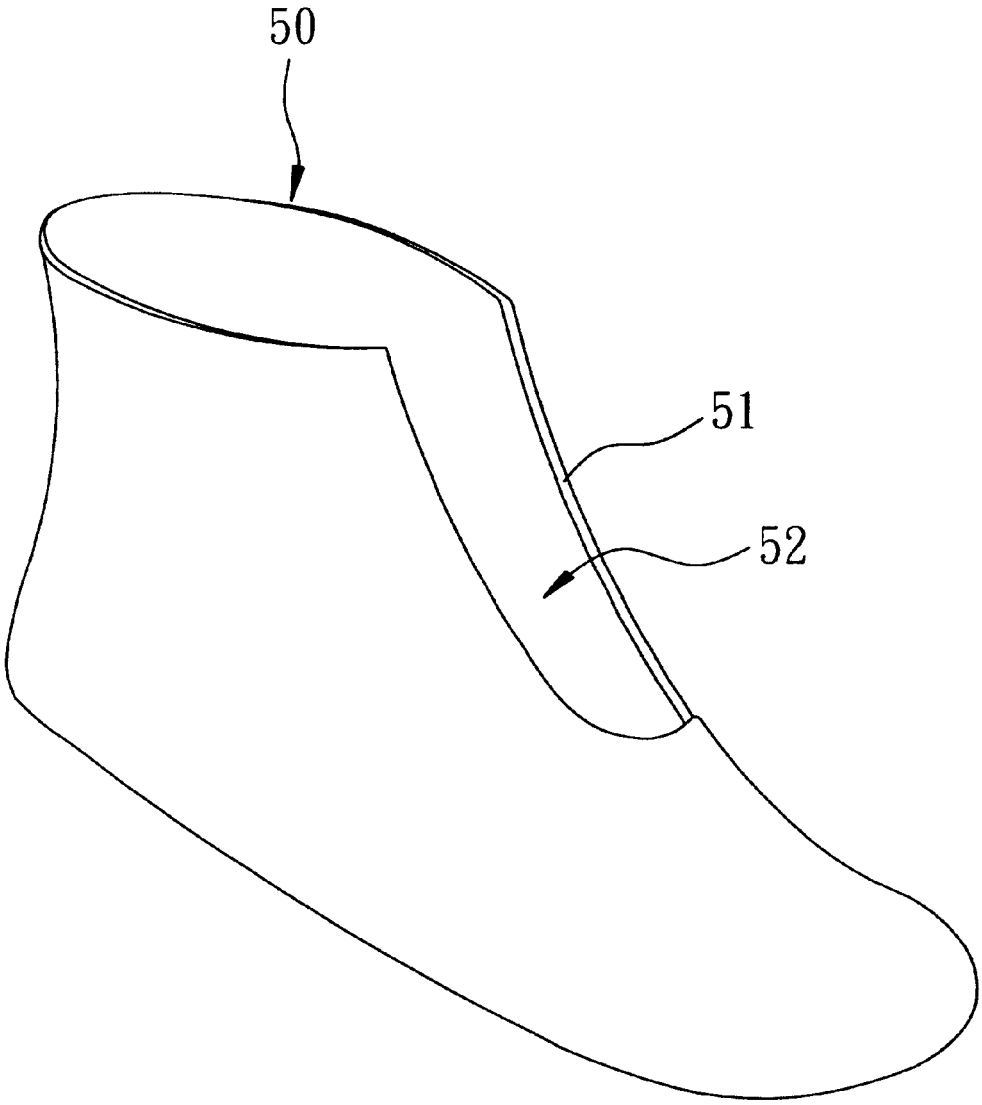
FIG. 6 is a perspective view of the lining of FIG. 5.

The waterproof lining 50 is shaped as a sock which has a top open end as best shown in FIG. 6. The waterproof lining 50 is disposed between the upper 20 and the inner lining 40, and has a third notched edge 51 which is contoured to correspond to the peripheral edge of the tongue 10 and which confines a cutout 52. The upper 20, the inner lining 40, and the waterproof lining 50 are sewn together at the top ends thereof. The third notched edge 51 of the waterproof lining 50 is adhered to the upper 20 along the outer seam 23. The waterproof lining 50 is made of a waterproof breathable membrane such as the product well-known under the tradename of Goretex or Sympatex.

The watertight sealing member 60 is in the form of a strip and is attached to the inner surfaces of the waterproof lining 50 and the outer layer 11 of the tongue 10 along the third notched edge 51. The entry of water through the outer seam 23 can therefore be prevented to keep dryness within the upper 20.

Since the third notched edge 51 of the waterproof lining 50 is attached or adhered to the outer seam 23 and since the watertight sealing member 60 is adhered to the inner surfaces of the third notched edge 51 and the outer layer 11, the shoe of this embodiment is waterproof in all parts thereof, including the region having the tongue 10 and the eyelet plate 22.

As mentioned above, the waterproof lining 50 has the cutout 52 to receive the tongue 10, and the tongue 10 is made of a stretchable material. Due to the stretchability of the tongue 10, the waterproof lining 50 of the shoe according to the present invention is not susceptible to breaking when the user's foot is inserted into the upper 20 by stretching the top open end of the upper 20. The stretchable tongue 10 also enables the user to easily put on or take off the shoe of the present invention. Furthermore, since the waterproof lining 50 is provided with the cutout 52, the material required to make the waterproof lining 50 can be reduced, thus saving the manufacturing costs. Moreover, due to the presence of the cutout 52 in the waterproof lining 50, the waterproof lining 50 need not be pleated at the tongue region of the shoe.

Figure 7:
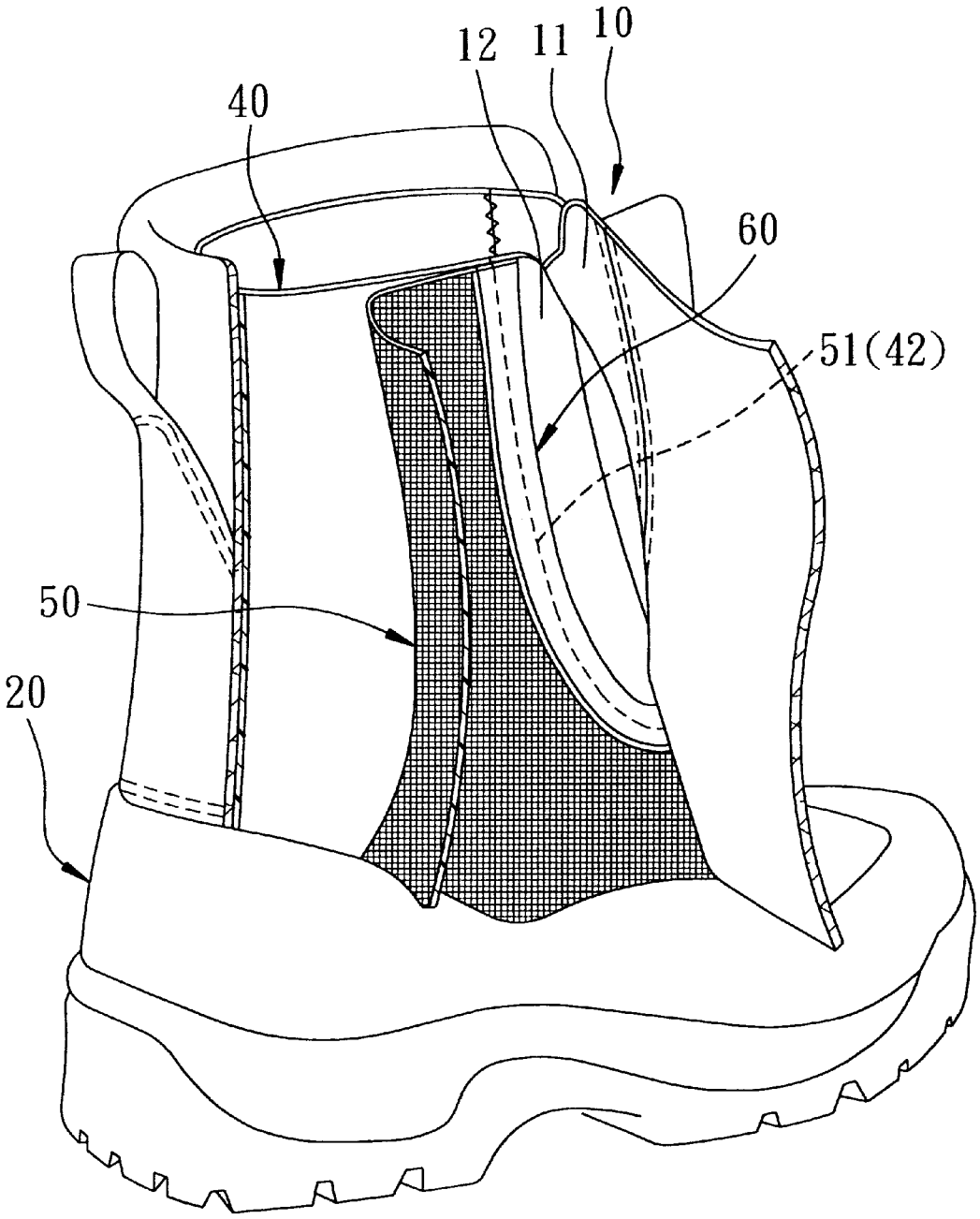
FIG. 7 is a partially sectioned view of a shoe of the second embodiment of the present invention.

Referring to FIG. 7 in combination with FIG. 6, a second embodiment of the shoe according to the present invention is shown to have a construction generally similar to that of the first embodiment. However, the second embodiment differs from the first embodiment in that the outer layer 11 is made of a non-waterproof stretchable material, and the inner layer 12 is made of a waterproof stretchable material such as a neoprene rubber. After the upper 20, the inner lining 40 and the waterproof lining 50 are sewn together at the top ends thereof, the third notched edge 51 of the waterproof lining 50 is adhered to the inner seam 42. The watertight sealing member 60 is disposed along the third notched edge 51 of the waterproof lining 50 and is adhered to the outer surface of the waterproof lining 50 and to the outer surface of the inner layer 12.

Figure 8:
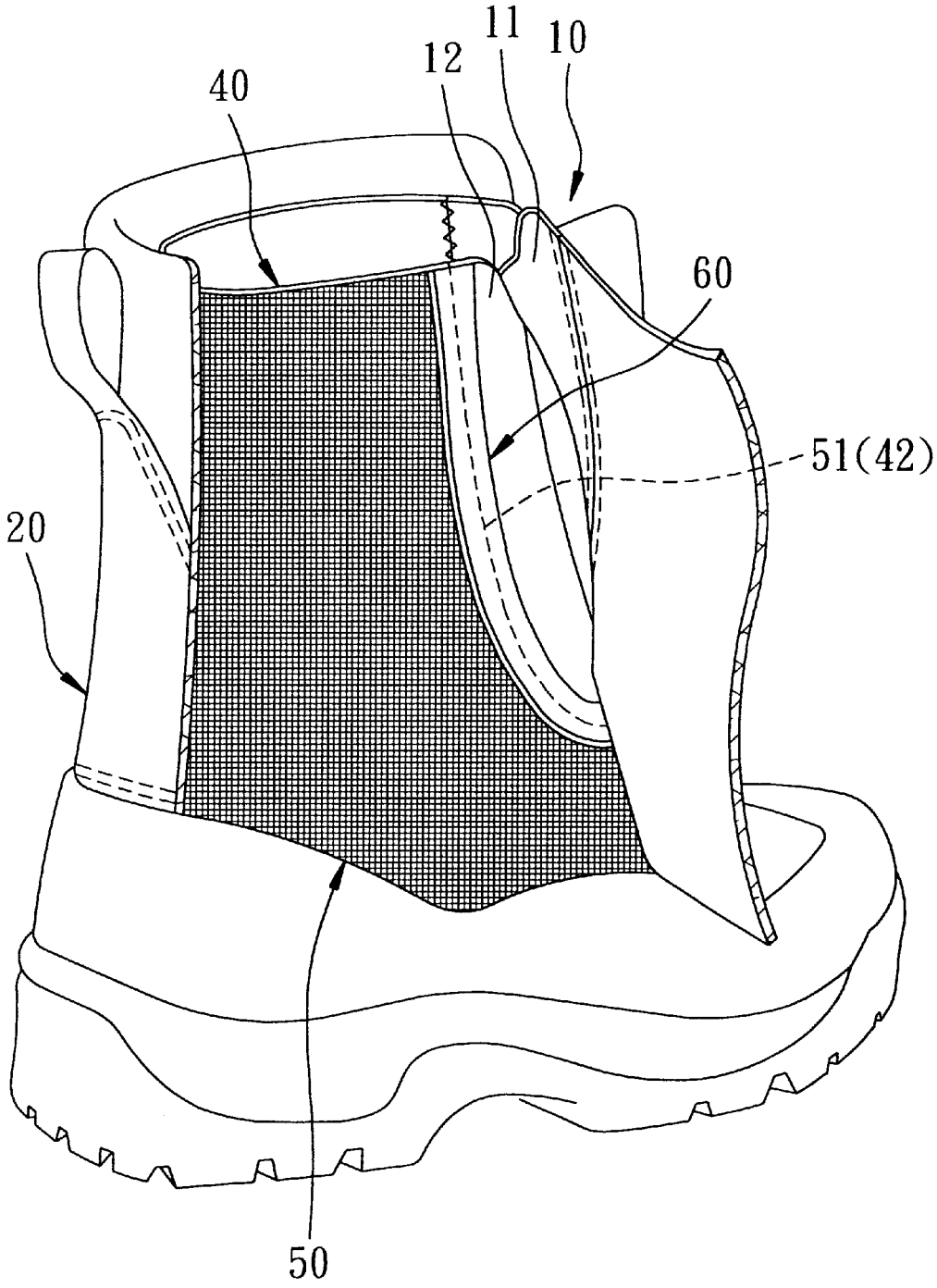
FIG. 8 is a partially sectioned view of a shoe of the third embodiment of the present invention.

FIG. 8 in combination with FIG. 6 illustrates a third embodiment of the present invention. The third embodiment differs from the first embodiment in that the outer layer 11 is made of a non-waterproof stretchable material, and the inner layer 12 is made of a waterproof stretchable material such as a neoprene rubber. In this embodiment, the waterproof lining 50 is adhered to the surface of the inner lining 40 beforehand and is disposed between the inner lining 40 and the upper 20. After the upper 20 and the inner lining 40 are sewn together at the top ends thereof, the third notched edge 51 of the waterproof lining 50 is attached to the inner seam 42. The watertight sealing member 60 is disposed along the third notched edge 51 of the waterproof lining 50 and is adhered to the outer surface of the waterproof lining 50 and the inner surface of the inner layer 12.

Figure 9:
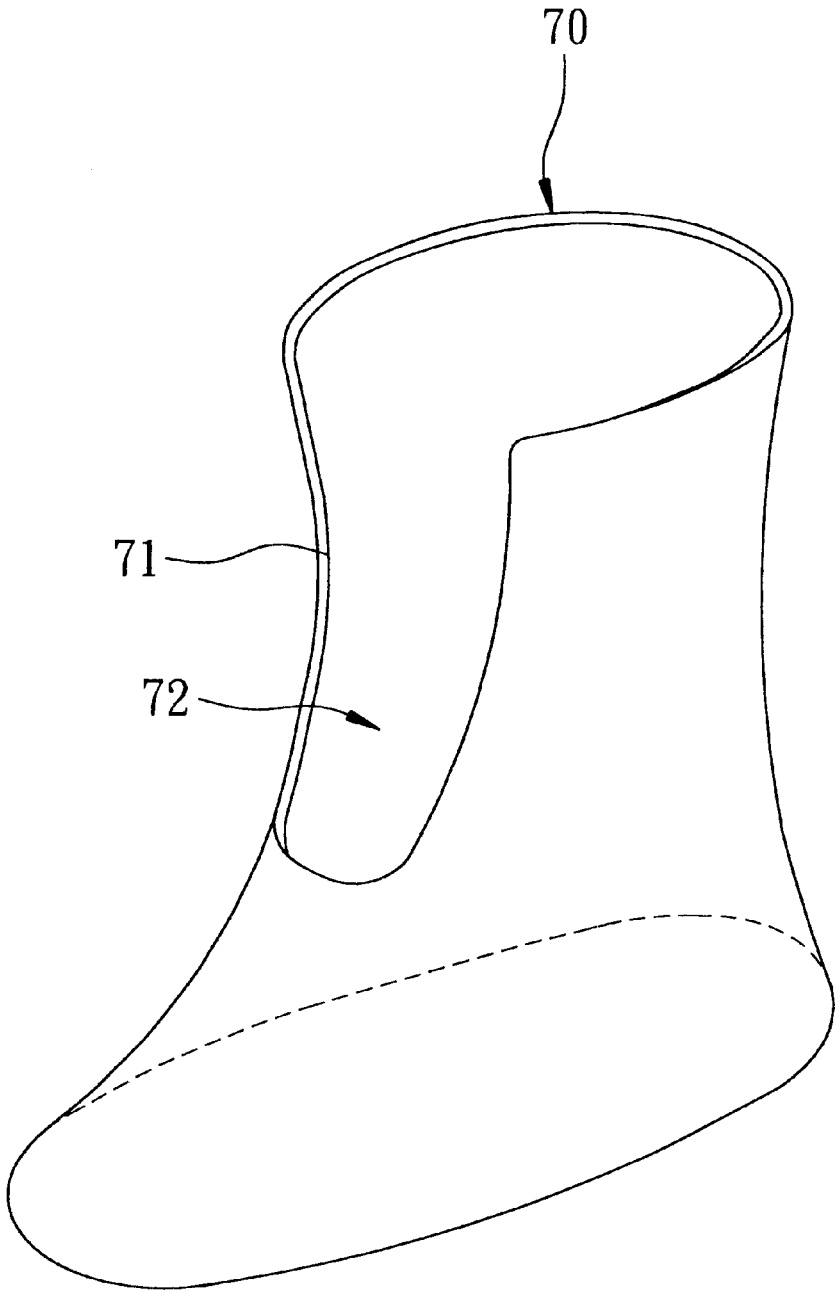
FIG. 9 is a perspective view of a lining of the fourth embodiment.

Referring to FIG. 9, a fourth embodiment of the present invention utilizes a waterproof lining 70 in place of the waterproof lining 50 of the previous embodiments. The waterproof lining 70 substantially conforms to a sock but has a bottom open end, in addition to the top open end. Like the waterproof lining 50, the lining 70 has the third notched edge 71 and the cutout 72.

Figure 10:
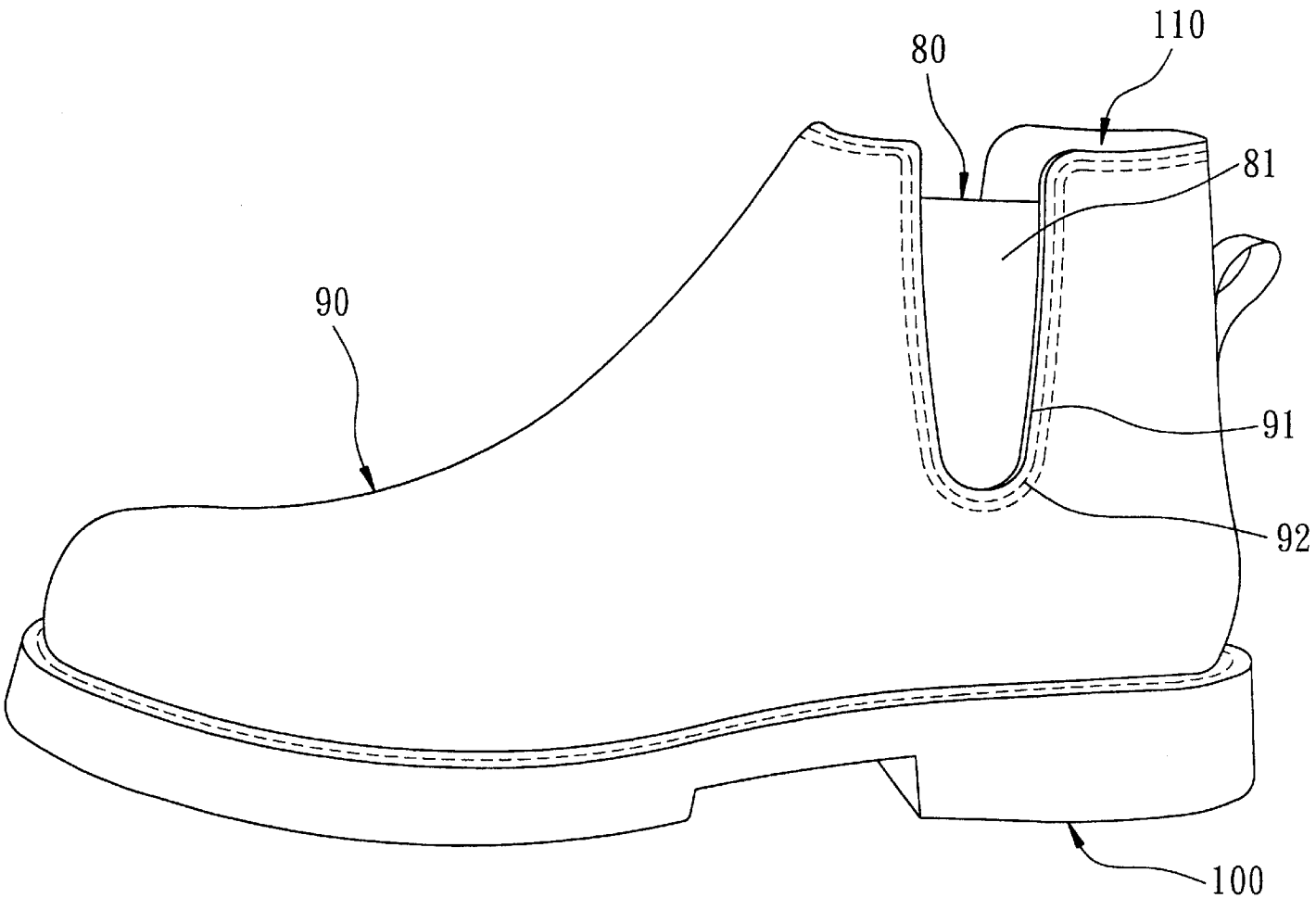
FIG. 10 is a perspective view of the fifth embodiment of the present invention.
Figure 11:
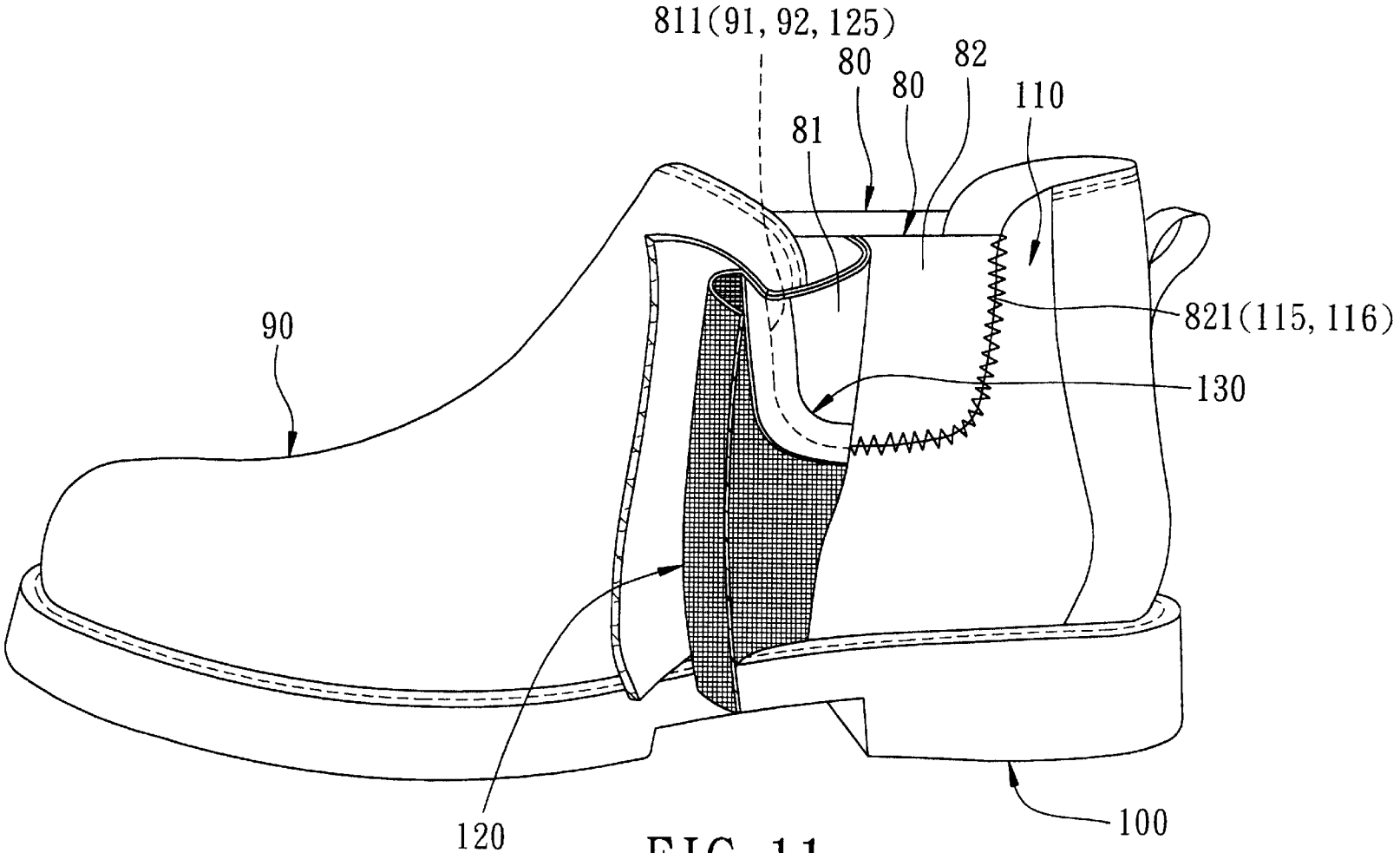
FIG. 11 is a partially sectioned view of the fifth embodiment.
Figure 12:
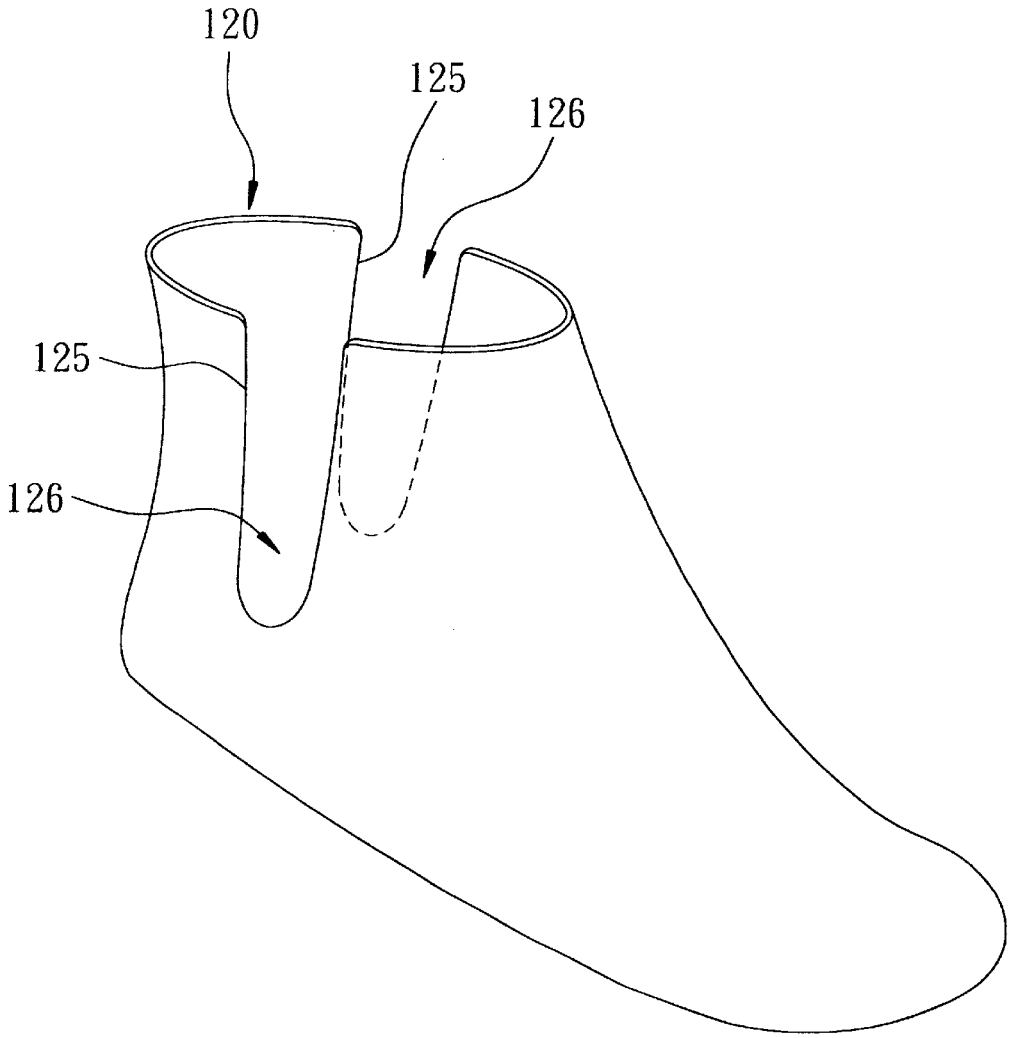
FIG. 12 is a perspective view of the lining used in the fifth embodiment.

Referring to FIGS. 10, 11, and 12, a fifth embodiment of the present invention includes a shoe, specifically a "Romio" style shoe. This shoe comprises an upper 90, two elastic parts 80, an outsole 100, an inner lining 110, a waterproof lining 120, and two watertight sealing members 130.

Each elastic part 80 is made of a stretchable elastic waterproof material such as a neoprene rubber, and includes an outer layer 81, and an inner layer 82 opposite to the outer layer 81.

The upper 90 has two first notched edges 91 each of which is contoured to correspond to the peripheral edge of the corresponding elastic part 80. The first notched edges 91 are respectively provided at two quarter-regions of the upper 90. The peripheral edge 811 of the outer layer 81 is sewn together with the corresponding first notched edge 91 of the upper 90 to form an outer seam 92.

The inner lining 110 is disposed inside the upper 90 and has two second notched edges 115 which are contoured to correspond to the peripheral edge of the respective elastic parts 80. The peripheral edge 821 of the inner layer 82 of each elastic part 80 is sewn together with the second notched edge 115 of the inner lining 110 to form an inner seam 116.

The waterproof lining 120 is formed as a sock but has a bottom open end in addition to a top open end. The waterproof lining 120 is disposed between the upper 90 and the inner lining 110, and has two third notched edges 125 respectively confining cutouts 126. The third notched edges 125 of the waterproof lining 120 are disposed respectively along the outer seams 92.

The watertight sealing members 130 are disposed respectively along the third notched edges 125. Each watertight sealing member 130 is adhered to the inner surface of the waterproof lining 120 and the inner surface of the outer layer 81 of the corresponding elastic part 80.

The shoe of this embodiment provides an advantage over the conventional "Romio" style shoe which has at two sides thereof elastic bands that are prone to lose their elastic property over a period of use. Since this embodiment utilize s neoprene rubber for the elastic parts 80, the shoe of this embodiment not only is waterproof but also has good and durable elastic property.

Alternatively, the elastic parts 80 may also be fabricated by using an elastic fabric material in the outer layer 81 and a waterproof elastic material (e.g. neoprene) in the inner layer 82. The third notched edges 125 of the waterproof lining 120 may be attached to the inner seams 116. Each watertight sealing member 130 may be attached to the respective third notched edge 125 of the waterproof lining 120 and adhered to the outer surface of the waterproof lining 120 and the inner layer 82 of the elastic part 80. In addition, the waterproof lining 120 may also be adhered to the surface of the inner lining 110 beforehand and disposed between the upper 90 and the inner lining 110.

Figure 13:
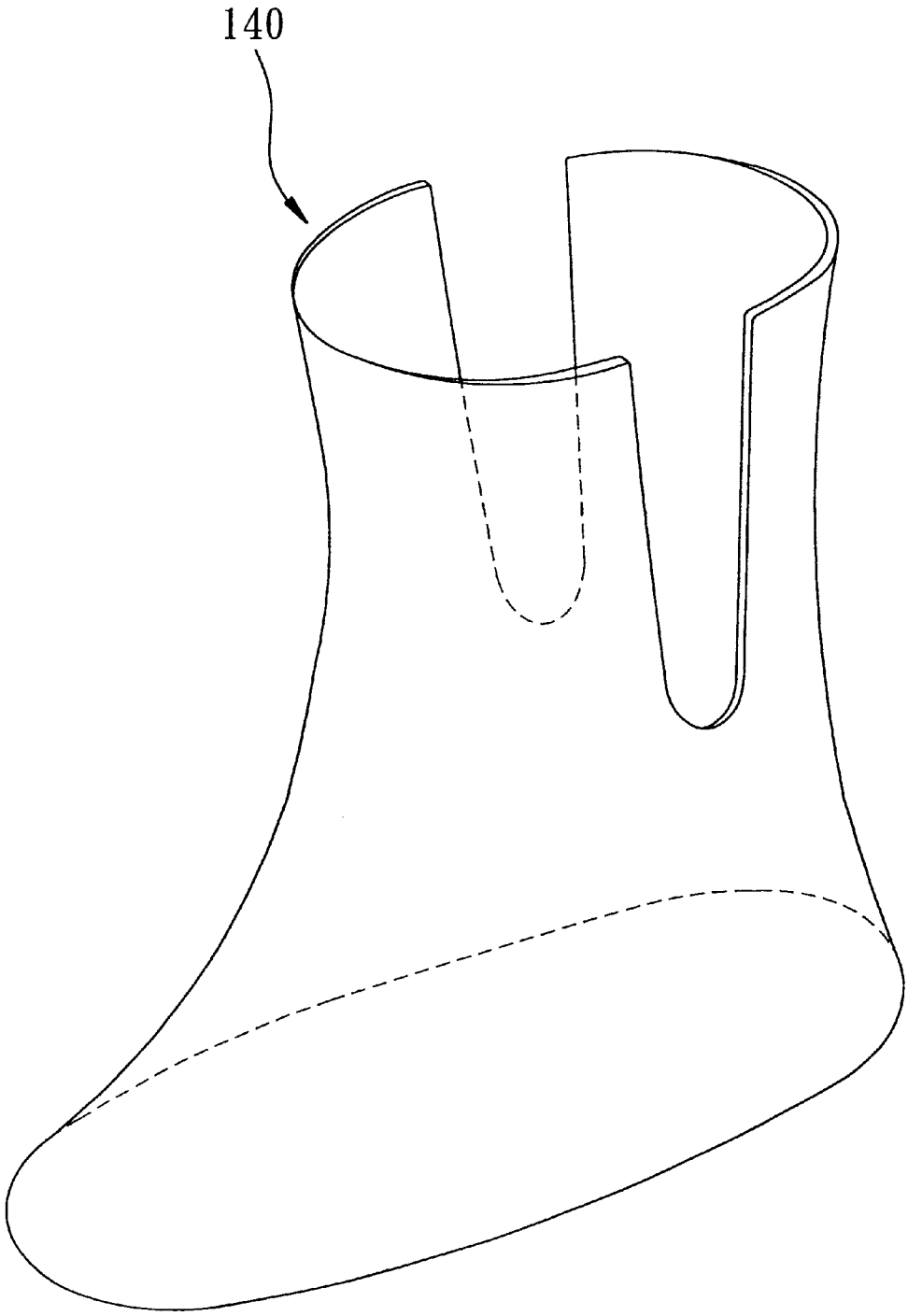
FIG. 13 is a perspective view of a lining of the sixth embodiment.

Referring to FIG. 13, a sixth embodiment of the present invention is generally similar to the fifth embodiment except that the sixth embodiment employs a waterproof lining 140 which is opened at the bottom end thereof.

Figure 14:
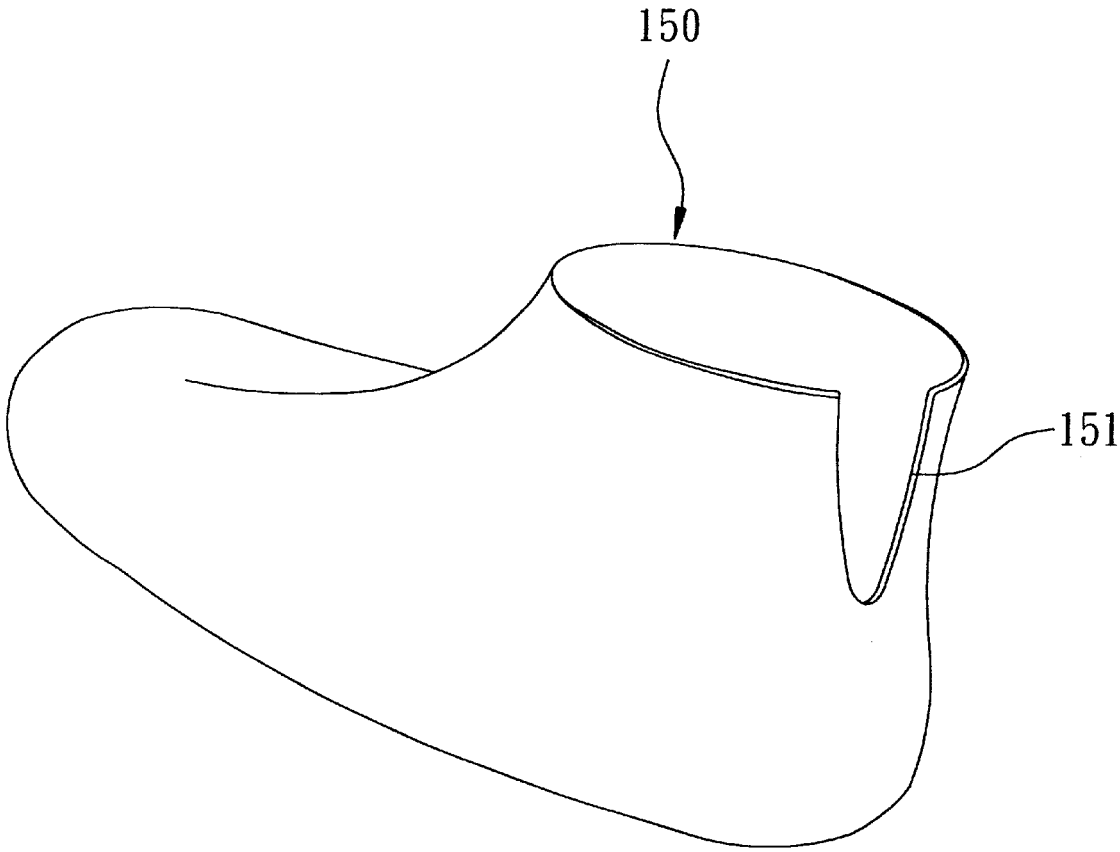
FIG. 14 is the same view as FIG. 12 but with a single notched edge at the top end of the lining.
Figure 15:
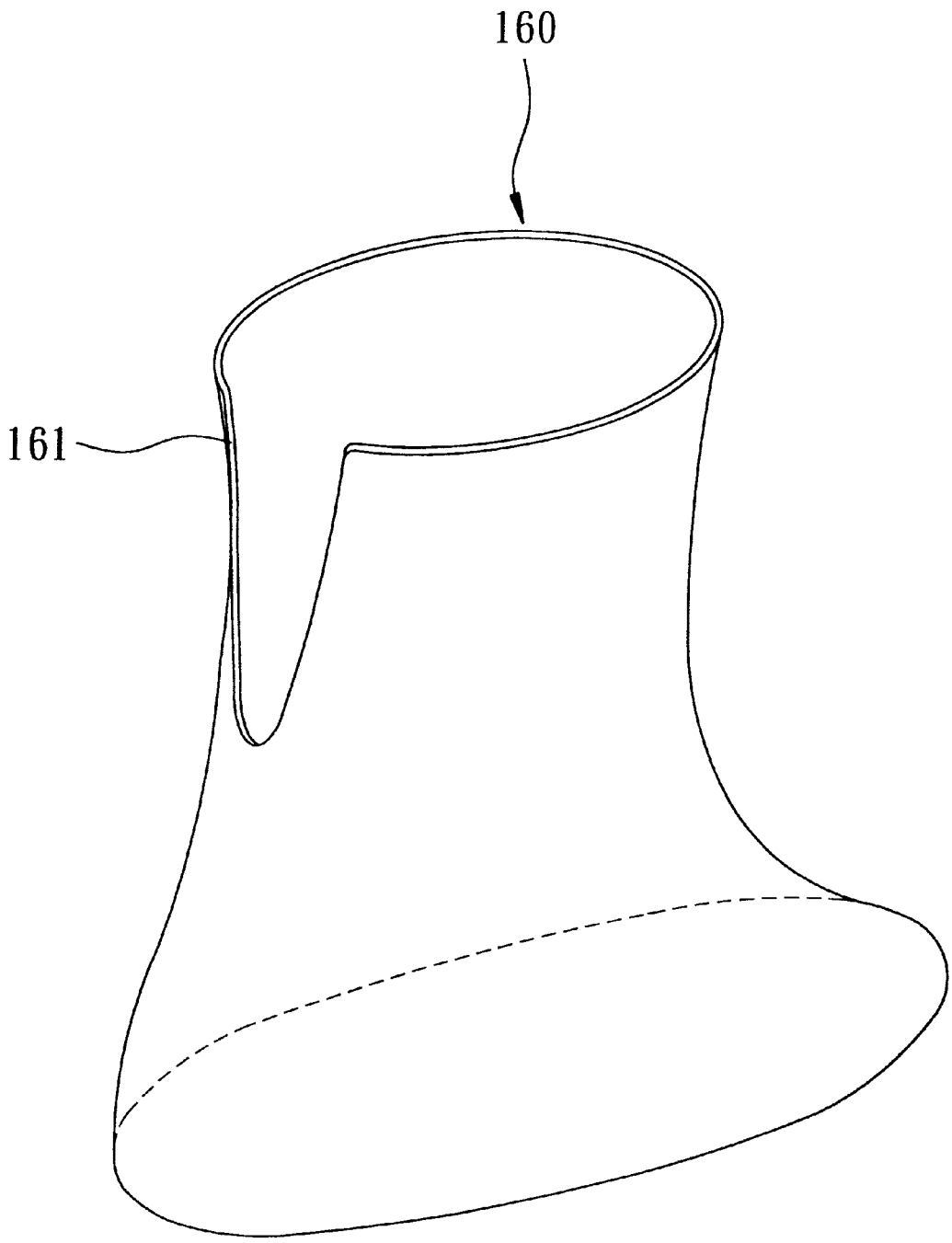
FIG. 15 is the same view as FIG. 14 but with the bottom of the lining being opened.

Alternatively, the present invention may employ a waterproof lining 150 or 160 which has only one third notched edge 151 or 161 provided in a heel part thereof, as shown in FIG. 14 or 15.

While the present invention has been described in connection with what is considered the most practical and preferred embodiments, it is understood that this invention is not limited to the disclosed embodiment but is intended to cover various arrangements included within the spirit and scope of the broadest interpretation so as to encompass all such modifications and equivalent arrangements.

We claim:

1. A shoe comprising:

an upper having a first top end and a first notched edge extending downward from said first top end;

an inner lining disposed inside said upper, and having a second top end and a second notched edge extending downwards from said second top end and being substantially in alignment with said first notched edge;

a substantially sock-like waterproof lining made of a waterproof breathable membrane and disposed between said upper and said inner lining, said waterproof lining having a third top end and a third notched edge extending downwards from said third top end and being in alignment with said first notched edge;

an elastic part to span said first, second and third notched edges, and having an outer layer and an inner layer both of which are elastic and stretchable, said outer and inner layers respectively including top ends connected to each other, said inner layer having a peripheral edge extending downward from said top end of said inner layer and attached to said second notched edge, thus forming an inner seam, said outer layer having a peripheral edge extending downward from said top end of said outer layer and attached to said first notched edge, thus forming an outer seam, said third notched edge of said waterproof lining being attached to one of said first and second notched edges along one of said inner and outer seams; and a watertight sealing member to seal at least one of said inner and outer seams.

2. The shoe as claimed in claim 1, wherein at least one of said outer and inner layers is waterproof.

3. The shoe as claimed in claim 1, wherein said first notched edge of said upper is disposed in an instep portion of said upper to confine a cutout, said elastic part being formed as a tongue to span said cutout.

4. The shoe as claimed in claim 2, wherein said upper further includes a substantially U-shaped eyelet plate in said instep portion, said eyelet plate having a substantially U-shaped inner edge defining said first notched edge, a substantially U-shaped outer edge spaced apart from and extending around said U-shaped inner edge, and a plurality of eyelets disposed along said U-shaped inner edge.

5. The shoe as claimed in claim 1, wherein said outer layer of said elastic part is waterproof, said third notched edge of said waterproof lining being attached to said first notched edge of said upper, said watertight sealing member being disposed along said outer seam and adhered to said waterproof lining and said outer layer of said elastic part.

6. The shoe as claimed in claim 1, wherein said inner layer of said elastic part is waterproof, said third notched edge of said waterproof lining being attached to said second notched edge of said inner lining, said watertight sealing member being disposed along said inner seam and adhered to said waterproof lining and said inner layer of said elastic part.

7. The shoe as claimed in claim 1, wherein at least one of said inner and outer layers of said elastic part is made of a neoprene rubber.

8. The shoe as claimed in claim 1, wherein both of said inner and outer layers of said elastic part are made of a neoprene rubber.

9. The shoe as claimed in claim 6, wherein said elastic part further includes an elastic fabric material covering said neoprene rubber.

10. The shoe as claimed in claim 1, wherein said first, second and third notched edges are disposed at a quarter portion of said upper.

11. The shoe as claimed in claim 1, wherein said first, second, and third notched edges are disposed at a heel portion of said upper.

12. The shoe as claimed in claim 1, wherein said sock-like waterproof lining has a bottom open end opposite to said third top end.

* * * * *